US008914926B2

(12) United States Patent
Berhanu

(10) Patent No.: US 8,914,926 B2
(45) Date of Patent: Dec. 23, 2014

(54) PORTABLE SLEEPING TABLE APPARATUS AND METHOD

(76) Inventor: Nahome Berhanu, Dumphries, VA (US)

( * ) Notice: Subject to any disclaimer, the term of this patent is extended or adjusted under 35 U.S.C. 154(b) by 24 days.

(21) Appl. No.: 13/563,485

(22) Filed: Jul. 31, 2012

(65) Prior Publication Data

US 2014/0033439 A1 Feb. 6, 2014

(51) Int. Cl.
*A47C 20/00* (2006.01)

(52) U.S. Cl.
USPC ..... 5/640; 5/634; 5/636; 5/657

(58) Field of Classification Search
USPC ..... 5/640, 634, 633, 657, 638, 632, 630; 248/118
See application file for complete search history.

(56) References Cited

U.S. PATENT DOCUMENTS

| | | | | |
|---|---|---|---|---|
| 2,250,026 | A * | 7/1941 | Laukhuff | 5/634 |
| 3,050,355 | A | 5/1959 | Hess et al. | |
| 4,440,443 | A | 4/1984 | Nordskog | |
| 5,975,638 | A | 11/1999 | Schreiner | |
| 6,000,659 | A | 12/1999 | Brauer | |
| 6,684,431 | B2 * | 2/2004 | Splane, Jr. | 5/657 |
| 6,805,403 | B2 | 10/2004 | Buch | |
| 7,832,802 | B2 | 11/2010 | Ehlers et al. | |
| 8,336,142 | B1 * | 12/2012 | See et al. | 5/634 |
| 2003/0167571 | A1 | 9/2003 | Corbin | |
| 2008/0238174 | A1 | 10/2008 | Cinquanta | |
| 2013/0232696 | A1 * | 9/2013 | Halimi et al. | 5/640 |

* cited by examiner

*Primary Examiner* — Peter M Cuomo
*Assistant Examiner* — Brittany Wilson
(74) *Attorney, Agent, or Firm* — Intellalegal; James W. Pravel

(57) ABSTRACT

A folding portable sleeping table comprises a planar member rotatably connected to at least one longitudinal support member. A support arm has a proximal and a distal end. The proximal end of the support arm is rotatably connected to the planar member. The longitudinal support member has notches to engage the distal end of the support arm. The longitudinal support member has a hollow interior sized to accept at least one extendable member. A base member is positioned on a lower end of the at least one extendable member. The at least one extendable member is adjustably secured to the at least one longitudinal support member whereby the base member and the at least one extendable member can extend in and out relative to the at least one longitudinal support member.

7 Claims, 7 Drawing Sheets

PORTABLE SLEEPING TABLE APPARATUS AND METHOD

PRIORITY CLAIM

This application claims the benefit of Provisional Application No. 61/214,763, which was filed on Aug. 3, 2011.

FIELD OF THE INVENTION

This invention relates to the field of folding tables. More particularly, the invention relates to a portable sleeping table apparatus and method.

BACKGROUND

Travelling for extended periods of time on airplanes, buses or trains becomes tiring and uncomfortable. It is common to want to sleep while travelling or during layovers. However, the design of the seating is generally cramped and it becomes extremely uncomfortable to lean back for extended periods of time.

Some attempts have been made to solve the problem by restraining the head against the backrest. For example, U.S. Pat. Nos. 4,440,443 and 5,975,638 each show variations of a pillow that has restraining members to each side to prevent the user's head from falling to one side or the other.

Designs have been built for situations where space is not limited. Those designs convert an upright seating assembly to a fully reclined, lay down sleeping assembly. For example, see U.S. Pat. No. 6,000,659. Unfortunately, the necessary space is not typically available for such a reclined design in most airplanes, buses or trains.

An attractive option is to lean forward to relieve the lower back and neck. During layovers sometimes people will try to sleep by placing their travel bags on their laps and leaning forward to lay their heads on them. There have been attempts to provide an inflatable pillow type device that people can inflate and then lean forward on. For example see U.S. Patent Publication 2003/0167571. However, such an inflatable pillow tends to be bulky and if the person sitting in the seat in front of the inflatable pillow wants to lean back, they will be unable to do so unless the pillow is deflated. Furthermore, if the pillow is inflated, and a person sitting next to the pillow, toward the window, needs to get up to go to the restroom for example, the pillow will again need to be deflated to make room for the exiting passenger. The inflatable pillow solution also tends to be bulky and difficult to stow or carry. Yet further, because taller people require a taller pillow than a shorter person, a single sized inflatable pillow will not be comfortable for everyone. Further still, the inflatable pillow will tend to have a single angle on the surface on which to place the head and that single angle will not be comfortable for everyone.

Devices have also been designed which attach to the back of the seat in front of the user and include a tray on which the user can lay his or her head. For example, see U.S. Pat. Nos. 3,050,355 and 6,805,403. However neither device includes full vertical adjustment for people of different heights, nor are they readily transportable, nor can they be positioned as desired to one side or the other for a variety of sleep positions. Furthermore, if the person in front of the user adjusts their seat back, it changes the position of the tray on which the user is sleeping.

A compact, portable, adjustable foldable sleeping device is needed that does not suffer from the drawbacks described above.

SUMMARY

Applicant has invented a fully portable device that has an adjustable height so anyone short or tall can use it. The angle of the pillow support and pillow are adjustable so it is possible for the user to sleep with his or her head in a horizontal position or angled up or down from horizontal. The pillow support surface allows readjustment so that if the person in the seat in front decides to lean all the way back, the angle of the pillow can be readjusted to a comfortable position. The base pivots forwards and backwards to further adjust the pillow support. Also, the pillow is removable from the pillow support by attaching it to the pillow support with Velcro® brand hook and loop fastener or other temporary securing means. Because the pillow is removable, it can serve multiple purposes, such as for lumbar support or whatever other use may be desired. The inventive device is compact and is easy to use and set up for sleeping. It is easy to flatten and stow away the device under the seat, in an overhead compartment, or even in a magazine pocket. It is compact and not bulky, so if a person sitting in the window seat wants to go to the restroom and the person on the aisle seat is using the laptop pillow device, it is easy to move it out of the way. Also, the base of the device and the device overall are moveable easily so that for example, it can be moved to the side between the arm rest and the user's outer thigh, or to the window and their outer thigh and then by adjusting the height and angle that they are comfortable with, the user can sleep in a desired comfortable position. The pillow support can also include a slot on the upper surface, which can be used to support an electronic tablet device, such as an Ipad® brand tablet. The slot can also be used to support a magazine or book for easy reading.

The folding portable sleeping table comprises a planar member rotatably interconnected to at least one longitudinal support member. A support arm has a proximal and a distal end. The proximal end of the support arm is rotatably connected to the planar member. The longitudinal support member has notches to engage and restrict the movement of the distal end of the support arm. The longitudinal support member has a hollow interior sized to accept at least one extendable member. A base member is positioned on a lower end of the at least one extendable member. The at least one extendable member is adjustably secured to the at least one longitudinal support member whereby the base member and the at least one extendable member can extend in and out relative to the at least one longitudinal support member.

The at least one extendable member can be secured to the longitudinal member with a spring loaded latch member, with at least one spring-loaded retractable button or with a friction member, such as a compressive threaded bolt member.

DETAILED DESCRIPTION OF THE INVENTION

The following parts list will assist the reader in understanding the invention in relation to the description and attached drawings:

| Part Number: | Description: |
|---|---|
| N | Notched support assembly |
| 20 | Pillow support |
| 21 | Exit slot |
| 22 | Support member |
| 23 | Cord |
| 23b | Lower cord attachment |
| 24 | Support arm |
| 24a | Upper pin for support arm |
| 24b | Lower pin for support arm |
| 25 | Extendable Rod-slotted |
| 26 | Support crossbar |
| 28 | Spring |
| 28a | Upper spring attachment |
| 28b | Lower spring attachment |
| 32 | Latch |
| 32a | Pivot |
| 33 | Button |
| 33a | Button spring |
| 33b | Spring cavity |
| 34 | Retaining slot |
| 35 | Hole |
| 36 | Notches |
| 42 | Lower channel |
| 44 | Button |
| 45a,b,c,d | Pulleys |
| 47 | Transfer rod |
| 50 | Base plate |
| 52 | Pad |
| 60 | Bolt |
| 60a | Nut |
| 62 | Pillow |
| 63 | Tab |
| 64 | Hook and loop attachment to pillow |
| 70 | Hinge |
| 72 | Upper crossbar |
| 80 | Wing bolt |
| 82 | Nut |
| 122 | Support assembly |
| 122a | Support assembly notched member |
| 122b | Support assembly receiver |
| 125 | Extendable Rod |

Figure 1:
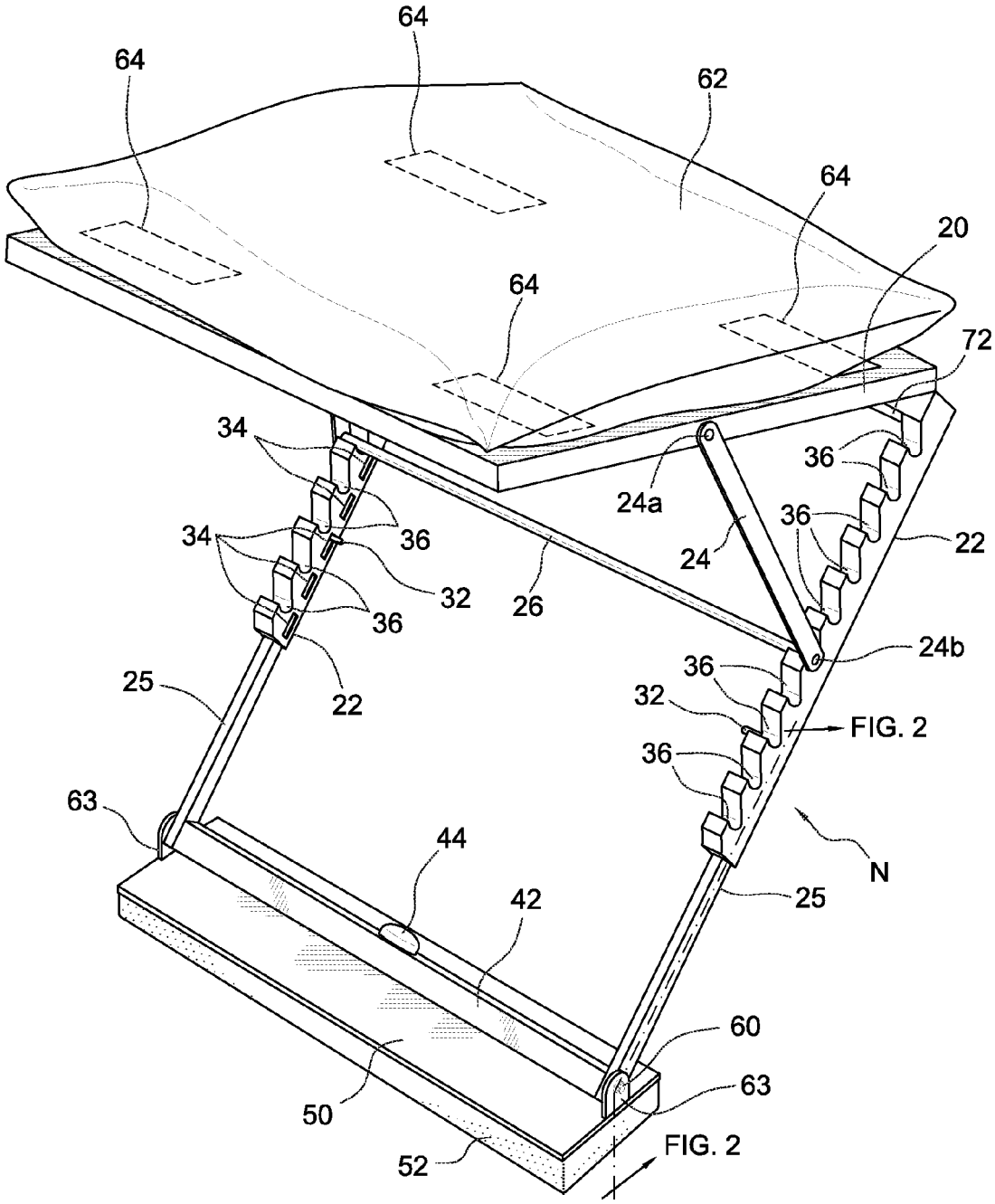
FIG. 1 shows an isometric view of the inventive portable sleeping table with a push button adjustment mechanism.

FIG. 1 shows an isometric view of the inventive portable sleeping table in the upright position. The pillow support 20 is generally in a horizontal position to provide a flat surface on which the user can put their head. A pillow 62 is provided and typically includes hook and loop 64, such as Velcro®, or other attachment means to temporarily secure the pillow 62 to the pillow support 20. Because the pillow 62 is removable, it can be used for purposes other than sleeping. For example, it can be used for lumbar support or any other desired purpose.

At least one support arm 24 is rotatably attached to the pillow support 20 with an upper pin 24*a* at the proximal end of the support arm. A pair of support arms 24 is generally used. A support crossbar 26 is positioned between the pair of support arms 24 as shown in FIG. 1. An upper crossbar 72, best seen in FIG. 6, connects the support members 22. At least one hinge 70 is attached to the upper crossbar 72 and the pillow support 20. The hinge 70 allows the pillow support 20 to pivot to adjust the position of the pillow support 20 and pillow 62 in any desired angular position from horizontal to above or below horizontal as desired. The pillow support 20 can also be hinged to the support member 22 or interconnected otherwise so that it is rotatable upwardly and downwardly. The support crossbar 26 engages notches 36 in the support member 22. The weight from the user's head, the pillow support 20 and the pillow 62 are all transferred to the support arm 24 to the support crossbar 26 and then to the desired notch 36. The angled position of the pillow support 20 and pillow 62 can be adjusted by changing the position of the support crossbar 26 in the desired notch 36. Each support arm 24 can also be connected to the support crossbar 26 to form a continuous c-shaped member.

Figure 2:
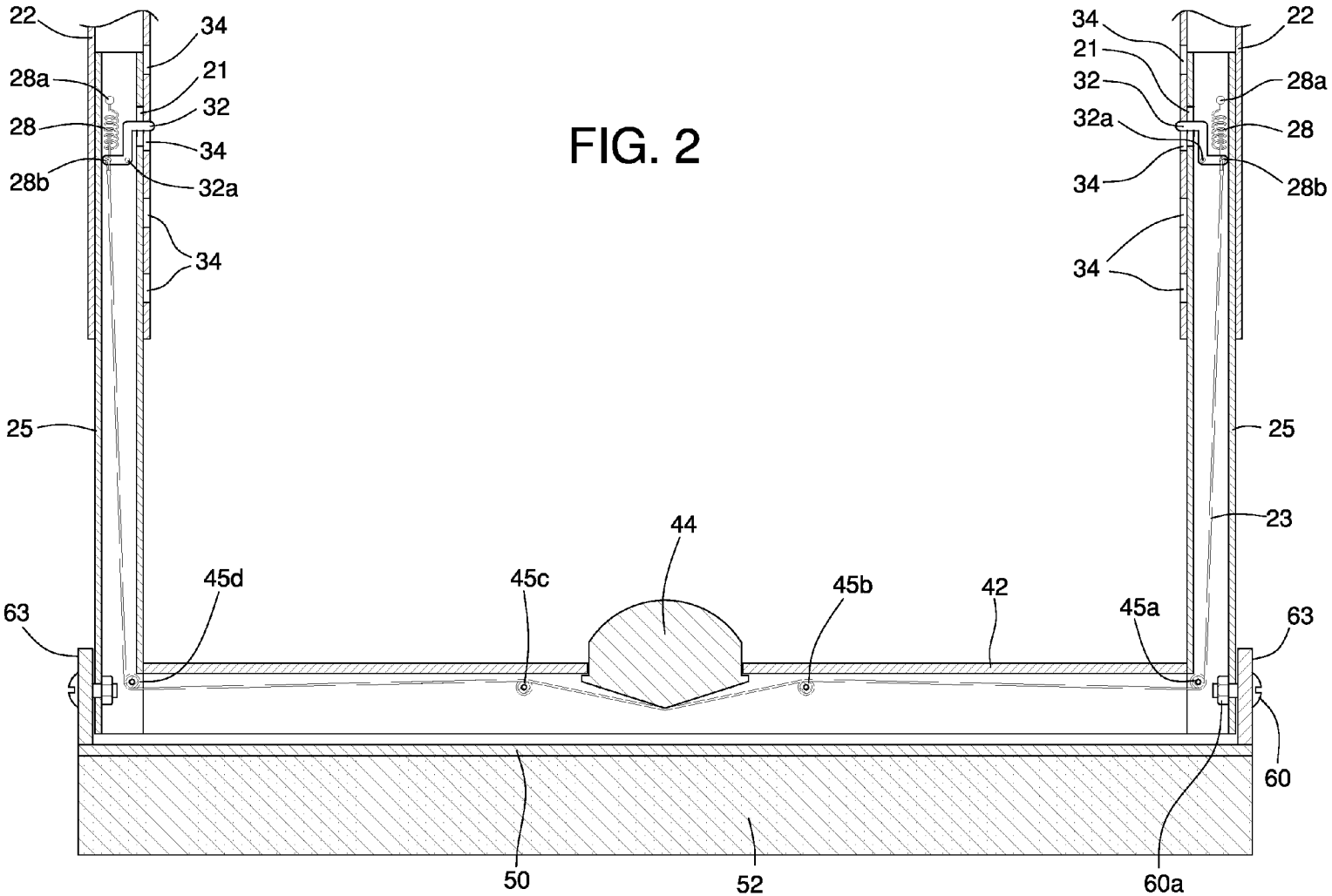
FIG. 2 is a detail section view taken from lines 2-2 indicated in FIG. 1.

The support member 22 has an opening to receive the extendable rod 25. Referring to FIG. 2, the extendable rod includes a latch 32 which rotates about pivot 32*a*. The latch 32 extends through exit slot 21 and retaining slot 34. A spring 28 is attached to latch 32 at the latch end 28*b* and at the spring retainer 28*a*. A cord 23 or other connection member is attached to the latch 32 at the latch end 28*b*. The cord 23 extends from the latch end 28*b* downward inside of the extendable rod 25, around pulley 45*a*, 45*b* and 45*c*. The cord 23 then extends around pulley 45*d* and up the opposite extendable rod 25 to the latch end 28*b* inside of the opposite extendable rod 25. A button 44 engages cord 23 between pulleys 45*b* and 45*c*. When button 44 is pressed, tension is imposed on cord 23, which pulls each latch end 28*b* downwardly and rotates the latch 32 inside of the slot 34 and inside of the extendable rod 25. When the latch 32 is rotated back, extendable rod 25 can be moved up or down into the desired position. Once each extendable rod 25 is in the desired position, the button 44 is released, which causes the spring 28 to pull the latch end 28*b* upward and rotates the latch 32 outward into the desired slot 34 to secure the extendable rod 25.

Figure 3:
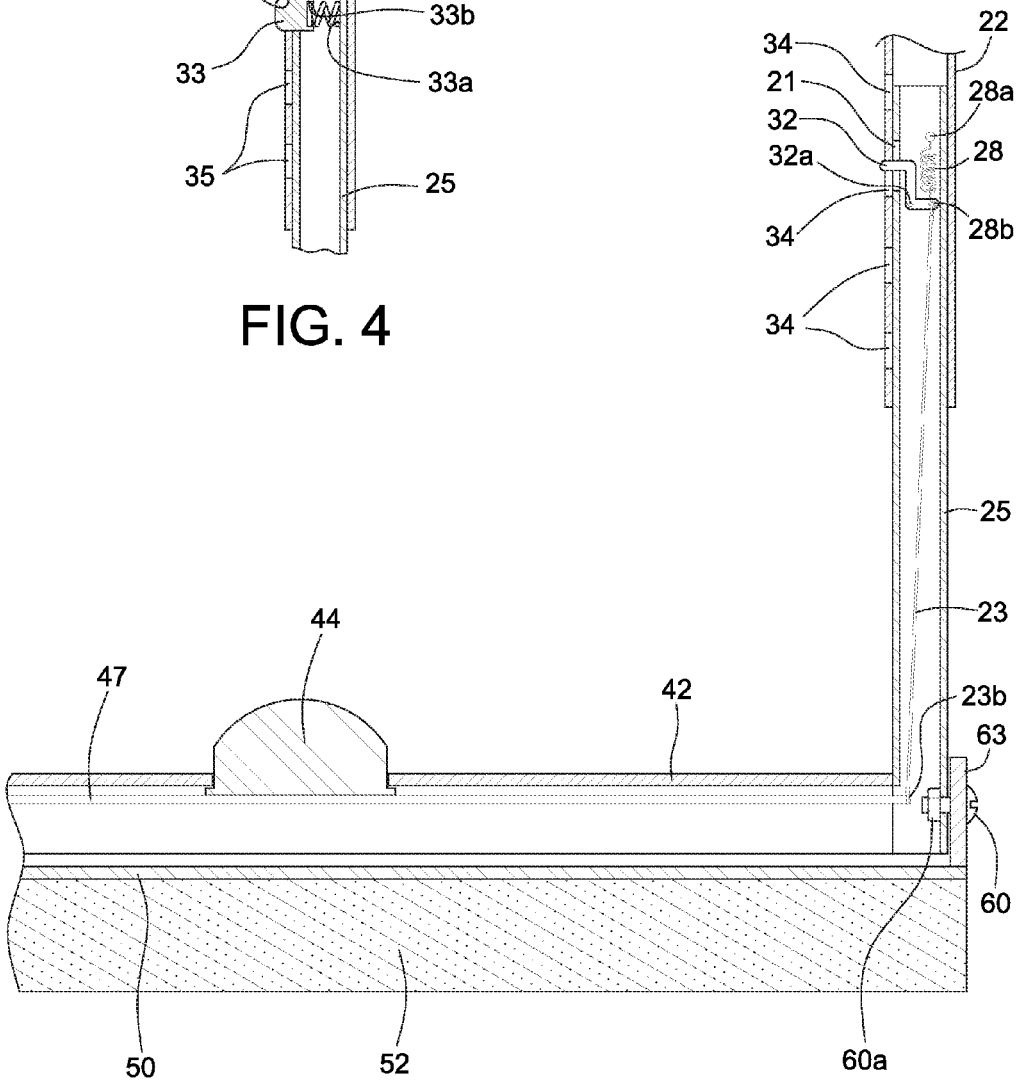
FIG. 3 is an alternative embodiment of the section shown in FIG. 2.

In FIG. 3 a transfer rod 47 is shown to which each lower cord attachment 23*b* is connected. When button 44 is pressed, transfer rod 47 is pushed downward, which pulls the latch end 28*b* downward and rotates the latch 32 inside of the slot 34 and inside of the extendable rod 25. When the latch 32 is rotated back, the extendable rod 25 can be moved up or down into the desired position. Once the extendable rod 25 is in the desired position, the button 44 is released, which causes the spring 28 to pull the latch end 28*b* upward and rotates the latch 32 outward into the desired slot 34 to secure the support member 22. Note that when operating the latch mechanism, the button causes the latch within each extendable rod 25 to actuate simultaneously. However, a single latch mechanism inside of only one extendable rod 25 could be used instead if desired. Having a latch mechanism in each extendable rod 25 however, will generally provide superior support to the entire assembly.

Figure 4:
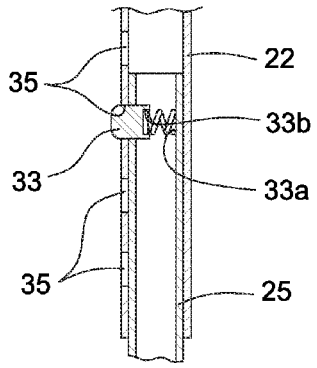
FIG. 4 shows an alternative latching mechanism between the support member and the extendable rod.

In FIG. 4 an alternative mechanism is shown to latch each support member 22 to each extendable rod 25. The button 33 extends through one of the holes 35. A button spring 33*a* extends into a spring cavity 33*b* in the bottom of the button 33. The bottom of the button spring 33*a* is attached to the inside of the extendable rod 25. When each button 33 is pressed simultaneously into a hole 35 in the support member 22, the extendable rod 25 can move. When the extendable rod 25 is moved in or out, the button 33 is restrained inside of the extendable rod 25 until it can exit through another hole 35. By pushing each button 33 in and changing the position of the extendable rod 25 as desired, the button 33 can be positioned in the hole 35 that will secure the extendable rod 25 in the desired position.

The inventor has contemplated additional latch mechanisms which may be used with the device. The latch mechanism may include alternative articulating members, or retracting members to releasably secure the extendable rod 25 into the desired position.

Figure 5:
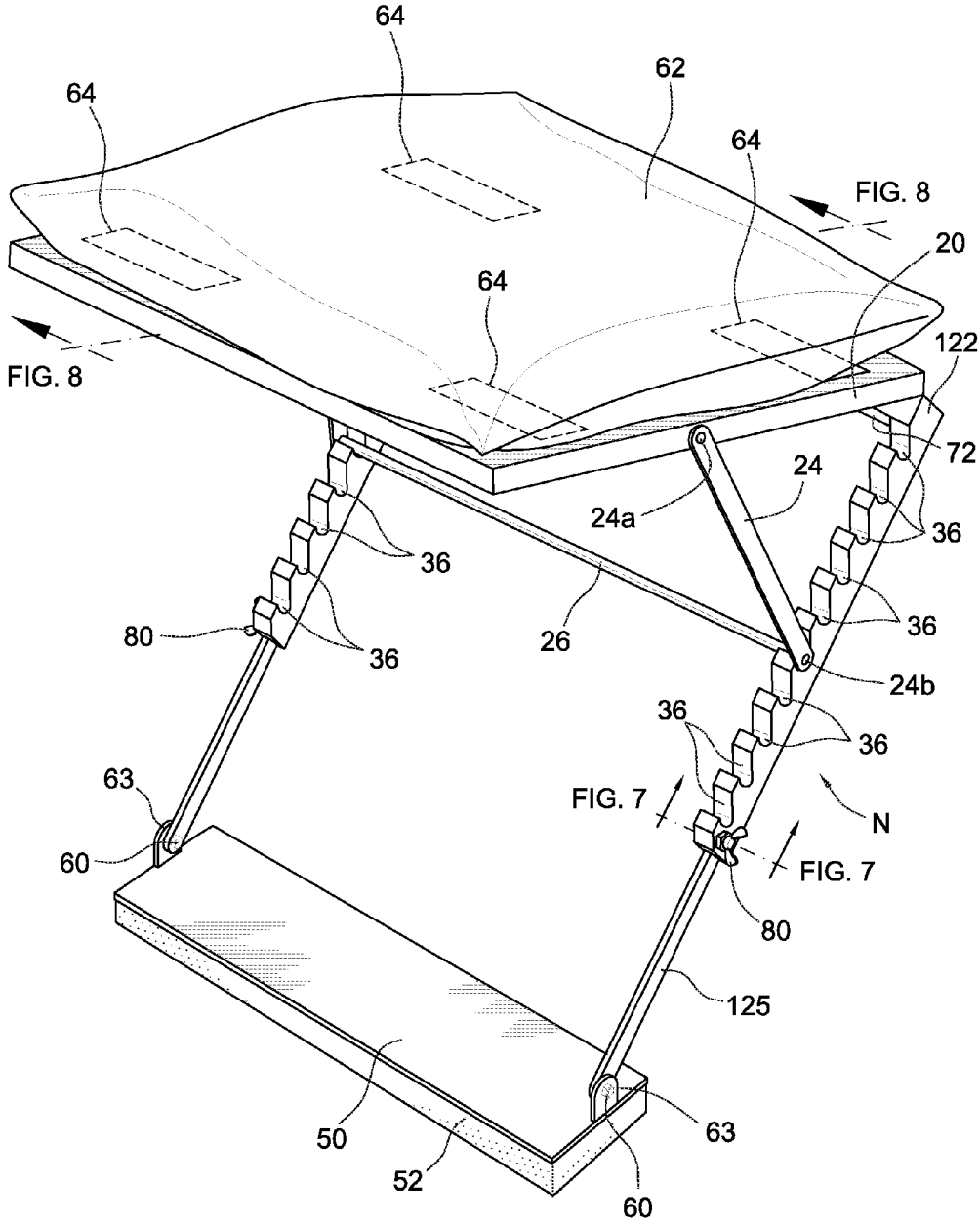
FIG. 5 shows an isometric view of the inventive portable sleeping table with a friction type adjustment mechanism.
Figure 10:
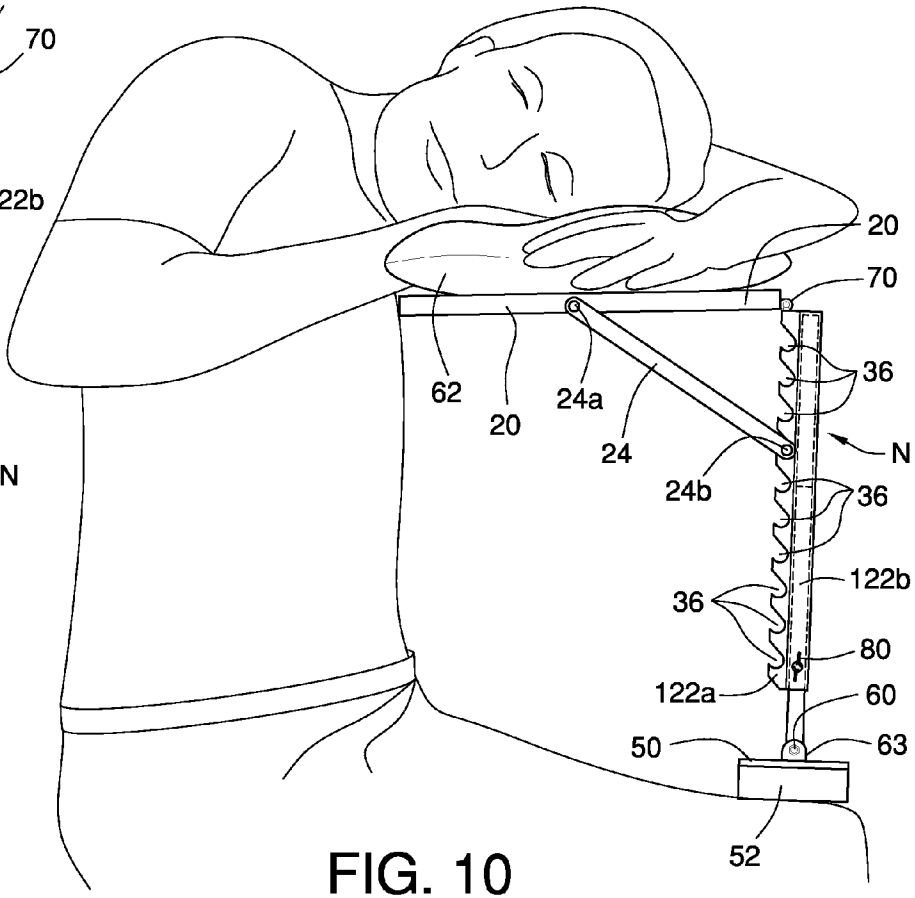
FIG. 10 shows the sleeping table of FIG. 5 with a user sleeping on the pillow and pillow support adjusted to a horizontal position.

A base plate 50, best seen in FIGS. 1 and 5, typically has a tab 63 at each end. Note that in FIG. 1 support member 22 includes slots 34, while in FIG. 5, support member 122 does not include slots 34. Each tab 63 is attached to the lower end of each extendable rod 25 (FIG. 1) and extendable rod 125 (FIG. 5). Each tab 63 is connected to each extendable rod 25 (FIG. 1) and extendable rod 125 (FIG. 5) with a bolt 60 and nut 60*a*, best seen in FIGS. 2 and 3. Other suitable fastener may also be used. A pad 52 is attached to the lower surface of the base plate 50. The pad 52 and base plate 50 rotate together as the tabs 63 rotate. The rotation of the pad 52 and base plate 50 allows the pad 52 to be positioned in any desired orientation on top of the user's thighs or on top of any relatively horizontal surface (See FIGS. 9 and 10). The base plate can also be connected to the extendable rod 25 or 125 with alternative means so long as the base plate can rotate relative to the extendable rod 25 or extendable rod 125.

Figure 8:
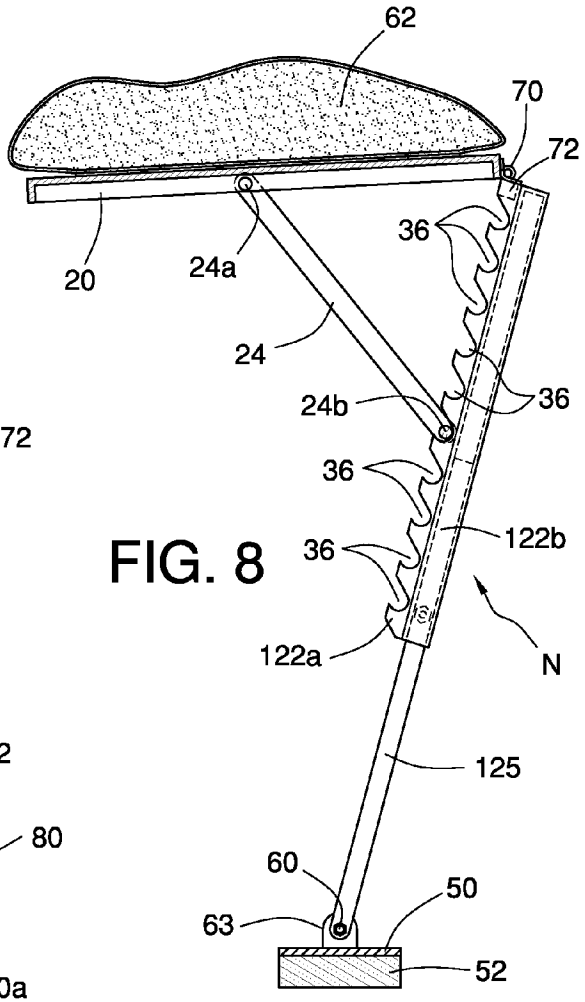
FIG. 8 shows a detail cross section taken from lines 8-8 indicated in FIG. 5.
Figure 7:
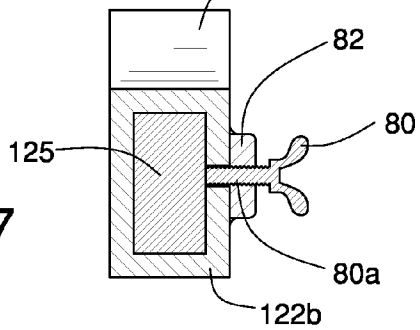
FIG. 7 shows a detailed cross section taken from lines 7-7 indicated in FIG. 5.

In FIG. 5 an alternative clamping mechanism is shown to secure each extendable rod 125 inside of each support assembly receiver 122*b* (Best seen in FIG. 8). A wing bolt 80, best seen in FIG. 7 extends through nut 82 and through the wall of support assembly receiver 122*b*. The wing bolt end 80*a* engages the outer surface of the extendable rod 125 to secure it in any desired position.

Figure 6:
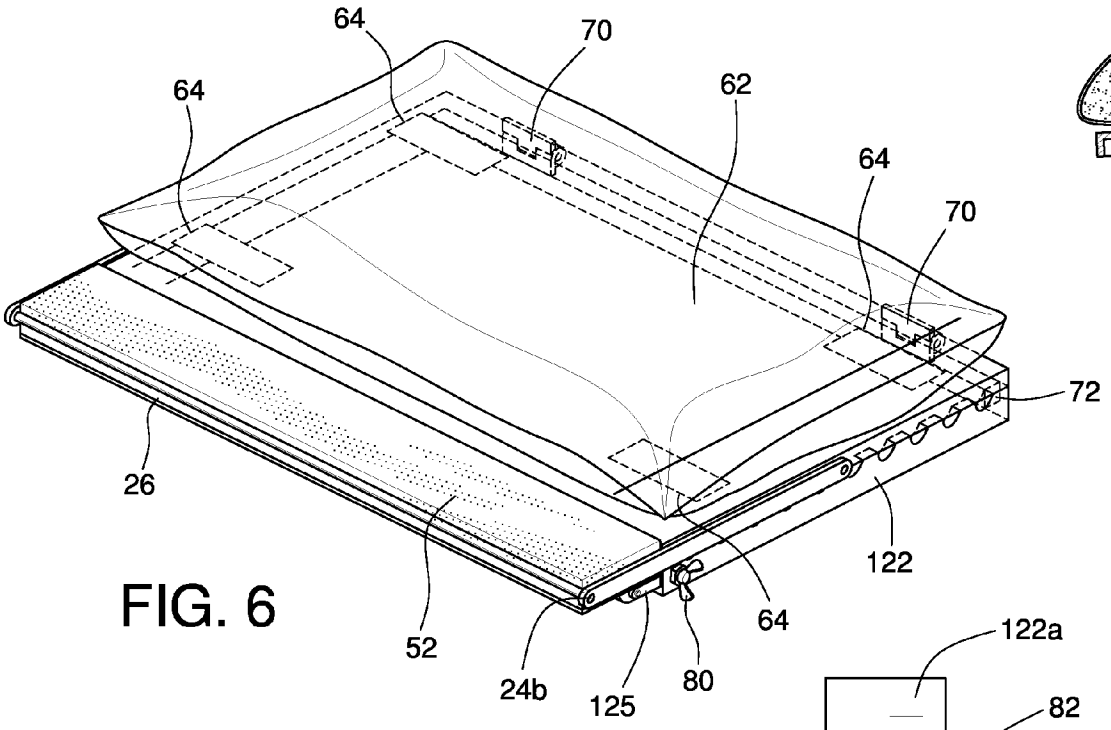
FIG. 6 shows the sleeping table of FIG. 4 in a fully collapsed configuration.

FIG. 6 shows the inventive portable sleeping table in a folded position. When folded, the portable sleeping table is compact and flat and can therefore be easily stowed under an airline seat, in a travel bag or in an overhead compartment. The components of the portable sleeping table can be fabricated from ultra lightweight materials such as polymers or aluminum or any desired combination thereof.

FIG. 8 shows the notched support assembly N, which comprises the support assembly receiver 122*b* and support assembly notched member 122*a*. The support assembly receiver 122*b* is hollow to accept the extendable rod 125. Because the support assembly receiver 122*b* supports the extendable rod 125 along the portion of the extendable rod 125 that is inside of the support assembly receiver 122*b*, the overall assembly remains strong to support the user's weight on the pillow support 20. The support assembly notched member 122*a* includes a plurality of notches 36 and may be fabricated separately from the support assembly receiver 122*b*. The separate assembly allows the support assembly notched member 122*a* to be fabricated as a solid piece, and then attached to the support assembly receiver 122*b*. This allows the support assembly notched member to be easily fabricated from a molded or other solid piece while still allowing the support assembly receiver 122*b* to be hollow to accept the extendable rod.

Figure 9:
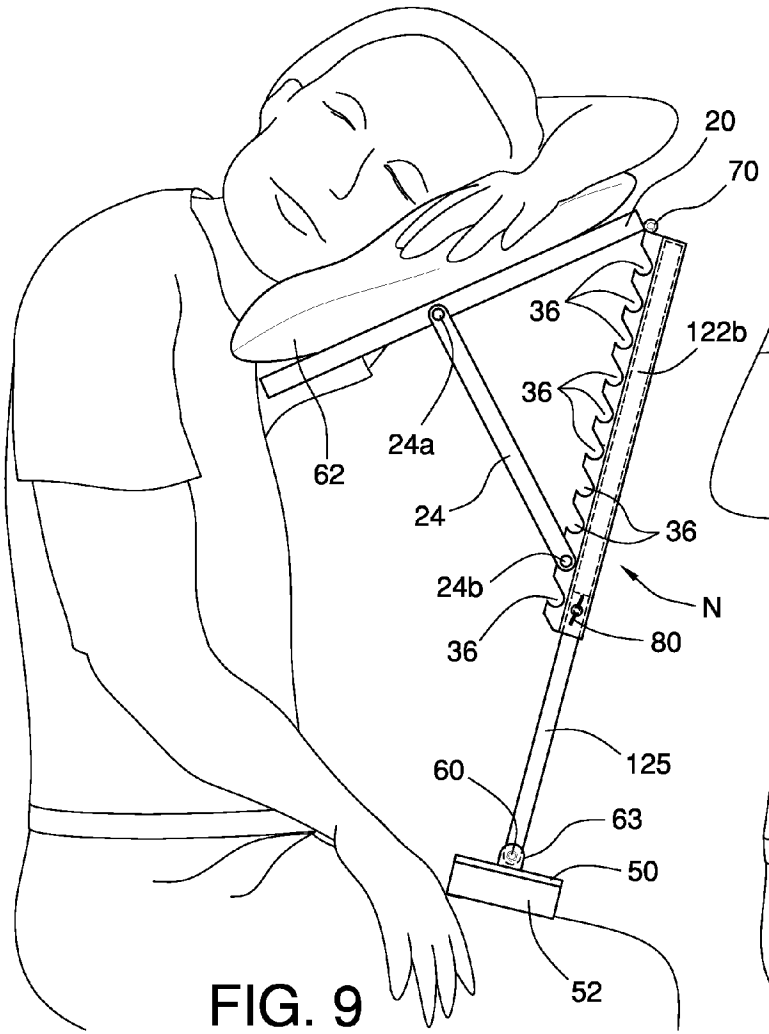
FIG. 9 shows the sleeping table of FIG. 5 with a user sleeping on the pillow and pillow support adjusted to a position less than horizontal.

In FIG. 9 the pillow support 20 is shown at an angle lower than horizontal. Each of the articulating members including the pillow support 20, the support arm 24 and the base plate 50 can each be rotated according to the user's preferences.

Figure 11:
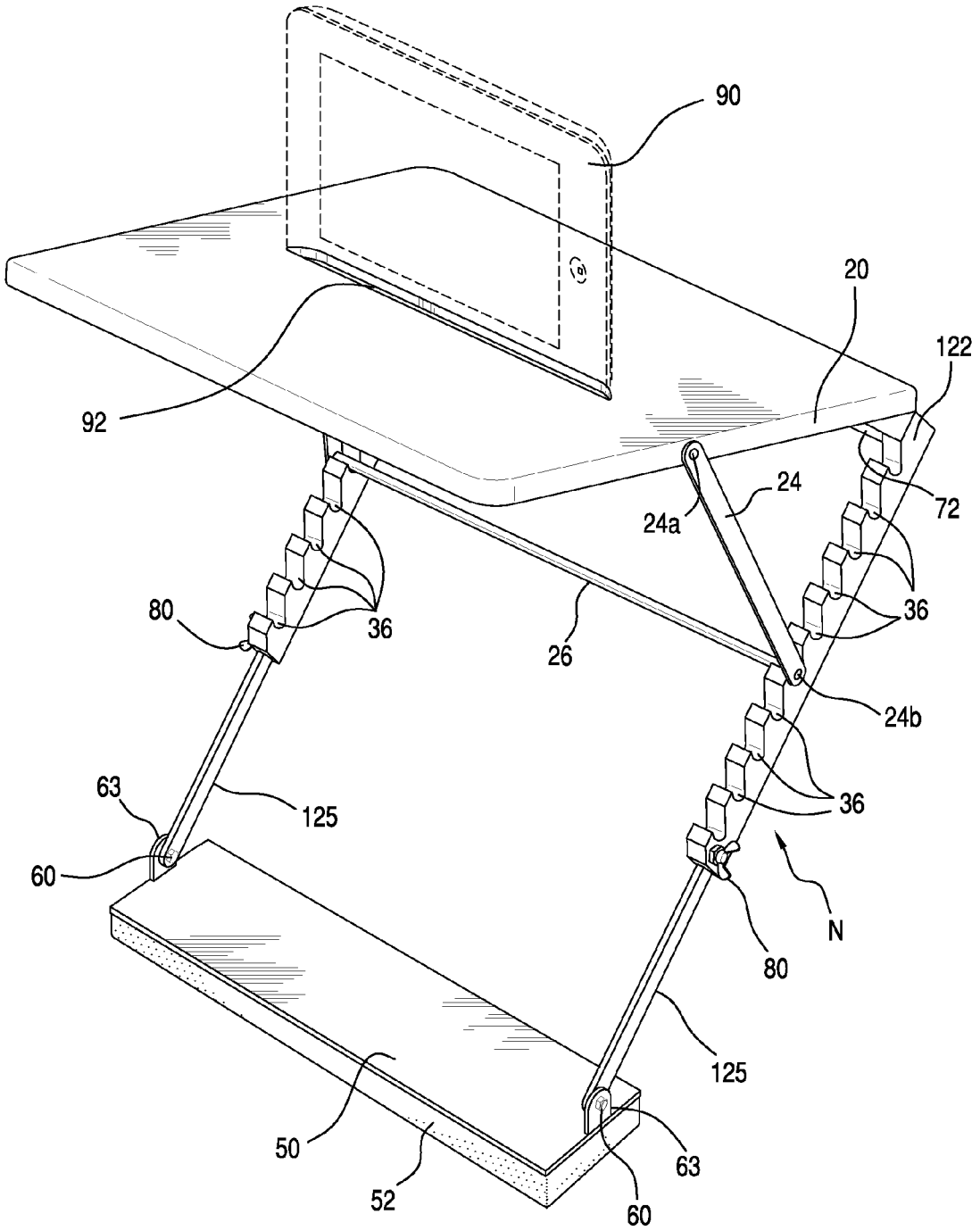
FIG. 11 shows the sleeping table of FIG. 5 with a recessed slot for holding a flat object, such as a tablet device or book.

As best seen in FIG. 11, the pillow support 20 can also include a slot 92 partially through or completely through the upper surface of the pillow support 20. The slot 92 is used to support an electronic tablet device 90 such as an Ipad® brand tablet, or any other flat item, such as a book or magazine. Positioning an electronic tablet device 90 or book or magazine provides for easy reading by the user.

The materials used to fabricate the disclosed sleeping table can be modified as desired to achieve weight and strength objectives. Minor variations in design details will not depart from the spirit and scope of the disclosed invention.

What is claimed is:

1. A folding portable sleeping table comprising:

a. A planar member rotatably interconnected to at least one longitudinal support member;

b. A support arm having a proximal and a distal end, said proximal end of said positioning member support arm being rotatably connected to said planar member;

c. Said longitudinal support member having notches; said notches constructed to restrict movement of said distal end of said support arm;

d. Said longitudinal support member having a hollow interior sized to accept at least one extendable member;

e. A base member positioned on a lower end of said at least one extendable member;

f. Said at least one extendable member being adjustably secured to said at least one longitudinal support member whereby said base member and said at least one extendable member can extend in and out relative to said at least one longitudinal support member; and g. wherein a plurality of slots are positioned along the length of said longitudinal support member, a latch extends into a desired slot of said plurality of slots to secure said extendable member in said longitudinal support member.

2. A folding portable sleeping table according to claim 1 wherein said latch is rotatably connected in said extendable member and is spring loaded in an extended position; a button is provided that is connected to a lower spring attachment with a cord; whereby when said button is pushed said latch is retracted from a slot and when said button is released said latch is urged toward a desired alternative slot in said longitudinal support member.

3. A folding portable sleeping table according to claim 1 wherein said base member is rotatable relative to said at least one longitudinal support member whereby said base member can be adjusted comfortably on the top of the user's thighs.

4. A folding portable sleeping table according to claim 1 wherein said base member has an upper and a lower planar surface and said base member includes a pad on said lower surface to provide comfort to the user when said base member is positioned on an upper thigh of the user.

5. A folding portable sleeping table according to claim 2 wherein said cord is guided on a plurality of pulleys that are positioned between said button and said lower spring attachment to provide smooth control of said latch.

6. A folding portable sleeping table according to claim 1 wherein a rod is attached to a lower spring attachment on said latch; said rod extends downward inside of said extendable member; a button is attached to said rod to release said latch to reposition the latch into a desired slot.

7. A method of making a folding portable sleeping table comprising:

a. Rotatably interconnecting a planar member to at least one longitudinal support member;

b. Rotatably connecting a proximal end of a positioning member to said planar member;

c. Restricting the movement of a distal end of said positioning member with notches constructed in said support member;

d. Accepting at least one extendable member in said at least one longitudinal member;

e. Positioning a base member on a lower end of said at least one extendable member;

f. Adjustably securing said at least one extendable member to said at least one longitudinal member whereby said base member and said at least one extendable member can extend in and out relative to said at least one longitudinal member;

g. adding a plurality of slots to said at least one longitudinal support member; and providing a latch that extends into a desired slot of said plurality of slots to secure said extendable member in said longitudinal support member.

* * * * *